US006989533B2

(12) United States Patent
Bellec et al.

(10) Patent No.: US 6,989,533 B2
(45) Date of Patent: Jan. 24, 2006

(54) PERMANENT MAGNET ION TRAP AND A MASS SPECTROMETER USING SUCH A MAGNET

(75) Inventors: Gérard Bellec, Versailles (FR); Pierre Boissel, Fontenay les Briis (FR); Michel Heninger, Etiolles (FR); Joël Lemaire, Antony (FR); Gérard Mauclaire, Limours (FR)

(73) Assignee: Centre National de la Recherche Scientifique (C.N.R.S.), Paris (FR)

( * ) Notice: Subject to any disclaimer, the term of this patent is extended or adjusted under 35 U.S.C. 154(b) by 0 days.

(21) Appl. No.: 10/504,591

(22) PCT Filed: Jan. 7, 2003

(86) PCT No.: PCT/FR03/00024

§ 371 (c)(1),
(2), (4) Date: Aug. 16, 2004

(87) PCT Pub. No.: WO03/069651

PCT Pub. Date: Aug. 21, 2003

(65) Prior Publication Data

US 2005/0092919 A1 May 5, 2005

(30) Foreign Application Priority Data

Feb. 14, 2002 (FR) ..... 02 01867

(51) Int. Cl.
*H01J 49/42* (2006.01)

(52) U.S. Cl. ..... 250/291; 250/396 ML

(58) Field of Classification Search ..... 250/291, 250/396 ML

See application file for complete search history.

(56) References Cited

U.S. PATENT DOCUMENTS

| | | | | |
|---|---|---|---|---|
| 3,937,955 | A | 2/1976 | Comisarow et al. | |
| 4,739,165 | A | 4/1988 | Ghaderi et al. | |
| 4,959,543 | A | 9/1990 | McIver et al. | |
| 5,451,781 | A | 9/1995 | Dietrich et al. | |
| 6,154,352 | A * | 11/2000 | Atallah | 361/143 |
| 6,858,962 | B2 * | 2/2005 | Post | 310/191 |

FOREIGN PATENT DOCUMENTS

WO WO 00/62313 10/2000

OTHER PUBLICATIONS

Schlapp M et al.: "A 14 GHZ Electron-Cyclotron-Resonance (ECR) Ion Source for Ion-Electron Collision Studies", Nuclear Instruments & Methods in Physics Research, Section—B: Beam Interactions with Materials and Atoms, North-Holland Publishing Company, Amsterdam, NL, vol. 98, NR. 1/4, pp. 521-524 XP000511261 ISSN: 0168-583X p. 521-p. 524.

* cited by examiner

*Primary Examiner*—Kiet T. Nguyen
(74) *Attorney, Agent, or Firm*—Young & Thompson

(57) ABSTRACT

A vacuum ion trap includes a gastight processing enclosure and a permanent magnet defining a cavity and creating a directed magnetic field in the cavity, the enclosure being disposed inside the cavity and containing a confinement cell having at least two mutually parallel trapping electrodes perpendicular to the directed magnetic field, the trapping electrodes being connectable to a voltage generator. The trap includes at least one permanent magnet in the form of a hollow cylinder and structured with a Halbach cylinder type structure so as to generate the permanent magnetic field directed perpendicularly to the longitudinal axis of the cavity of the magnet. The trap is applicable in particular to Fourier transform mass spectrometry (FTICR).

16 Claims, 4 Drawing Sheets

PERMANENT MAGNET ION TRAP AND A MASS SPECTROMETER USING SUCH A MAGNET

FIELD OF THE INVENTION

The present invention relates to a magnetic trap for ions and to a mass spectrometer using such a trap.

BACKGROUND OF THE INVENTION

Ion traps are used in numerous applications in molecular physics, and in particular in the ion cyclotron resonance phenomena implemented, for example, in Fourier transform mass spectrometers or FTICRs.

Such magnetic traps for ions enable the ions to be held captive in a defined volume in order to perform various measurements such as detecting cyclotron movements.

Conventionally, magnetic traps for ions implement means for generating a uniform magnetic field of high intensity, said means comprising solenoids that are resistive or superconductive.

Such generator means enable magnetic fields to be obtained of high intensity that can be as great as 9.4 teslas (T) and they present great stability over time.

Nevertheless, such components are very bulky and can weigh several tons. In addition, they require complex power supply and cooling installations and they are therefore suitable for use only in fixed installations.

In order to enable mobile devices to be developed, certain magnetic traps for ions make use of permanent magnets (L. C. Zeller, J. M. Kennady, J. E. Campana, H. I. Kentamaa, Anal. Chem. 1993, 65, 2116–2118, U.S. Pat. No. 5,451,781 in the name of Dietrich).

However, such permanent magnets generate fields that are generally limited to about 0.4 T and/or that are of volumes that are too small.

The qualities of an ion trap are associated with the uniformity and the intensity of the magnetic field to which it is subjected. Certain performance features of a trap vary as a function of the square of the intensity of the magnetic field and a minimum value of about 1 T is recommended for a high performance application to mass spectrometry of the FTICR type.

Siemens' "Advance quantra" mass spectrometer uses a permanent magnet generating a magnetic field of tesla order, but in order to do that, it requires a closed geometrical shape that is highly constraining.

OBJECT OF THE INVENTION

The object of the present invention is to remedy that problem by defining a magnetic trap for ions in which the trap is of reduced size and weight, while maintaining good performance and a practical shape.

SUMMARY OF THE INVENTION

To this end, the invention provides a vacuum ion trap, the trap comprising a gastight processing enclosure and a permanent magnet defining a cavity and creating a directed magnetic field in said cavity, said enclosure being disposed inside said cavity and containing a confinement cell comprising at least two mutually parallel trapping electrodes perpendicular to said directed magnetic field, said trapping electrodes being connectable to a voltage generator, the trap being characterized in that it includes at least one permanent magnet in the form of a hollow cylinder and structured with a Halbach cylinder type structure so as to generate said permanent magnetic field directed perpendicularly to the longitudinal axis of the cavity of said magnet.

According to other characteristics:

the dimensions and the composition of the or each magnet are adapted to generate a uniform permanent magnetic field of intensity of at least 0.8 T;

the trap includes two permanent magnets in the form of hollow cylinders, both structured with a Halbach cylinder type structure, and of identical dimensions and composition, the magnets being disposed in axial alignment on the same longitudinal axis and being oriented in such a manner as to cause the magnetic fields they generate to be directed identically;

the two permanent magnets are spaced apart from each other along their longitudinal axis by a predetermined non-zero gap in order to increase the uniformity of said magnetic field;

said gap is less than 1 millimeters (mm);

the or each permanent magnet presents an inside diameter in the range 45 mm to 55 mm, an outside diameter in the range 180 mm to 220 mm, and a length in the range 90 mm to 110 mm;

the or each permanent magnet (30) is made up of individual segments of Nd—Fe—B;

said confinement cell further comprises two mutually parallel detector electrodes perpendicular to said trapping electrodes, said measurement electrodes being connectable to measurement means in order to transmit information relating to the movements of ions contained in said confinement cell;

said confinement cell further comprises two mutually parallel exciter electrodes perpendicular to said trapping electrodes, said exciter electrodes being connectable to an excitation signal generator in order to excite ions contained in said confinement cell;

said trapping, exciter, and detector electrodes are plane and rectangular in shape so that said confinement cell is generally in the form of a rectangular parallelepiped;

each of said exciter electrodes is constituted by four plates arranged generally in the form of a rectangular parallelepiped that is open via two opposite faces, said exciter electrodes being disposed on a common axis on either side of said trapping electrodes, said open faces facing each other so that said confinement cell is generally in the form of a tunnel;

said confinement cell that is generally in the form of a tunnel is placed on the longitudinal axis of said magnet;

said processing enclosure includes, at at least one end, a port-hole disposed on the axis of the cell that is generally in the form of a tunnel, and that allows photons to pass therethrough;

the processing enclosure includes means for connection to pump means and to means for injecting gas in order to control the density and/or the nature of the atmosphere inside the processing enclosure; and it is associated with means for emitting electrons towards said enclosure in order to generate ions at least in said confinement cell.

The invention also provides a mass spectrometer comprising a magnetic trap for ions, a pump device, a trapping voltage generator, and measurement means suitable for performing Fourier transform analysis of the cyclotron movement of ions contained in the ion trap, the mass spectrometer being characterized in that said magnetic trap for ions is a trap as described above.

BRIEF DESCRIPTION OF THE DRAWINGS

The invention will be better understood on reading the following description given purely by way of example and made with reference to the accompanying drawings, in which.

DETAILED DESCRIPTION OF THE INVENTION

Figure 1:
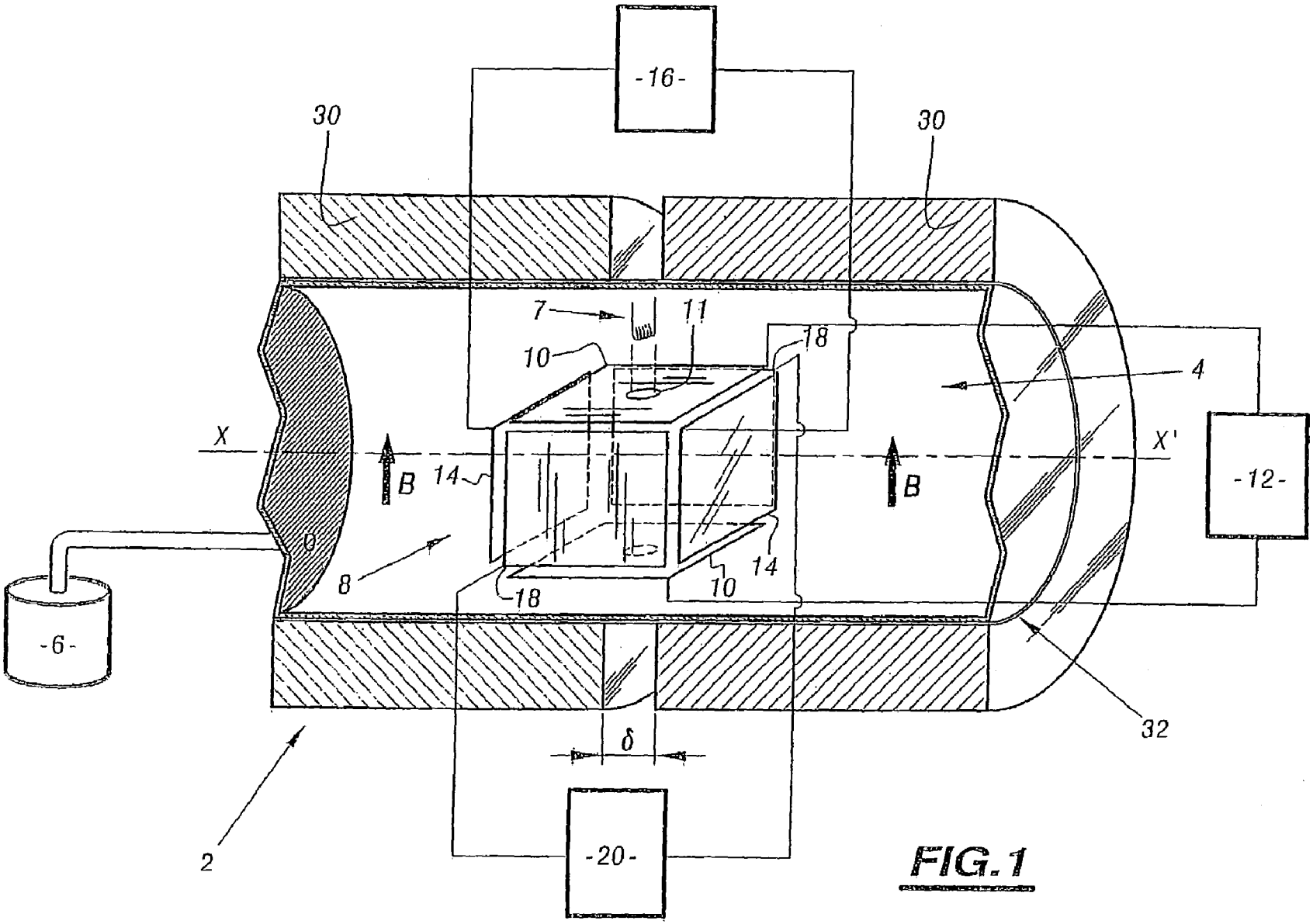
FIG. 1 is a diagram showing the principle of a mass spectrometer fitted with an ion trap of the invention and shown partially in section.

The Fourier transform mass spectrometer or FTICR shown in FIG. 1 is fitted with a magnetic trap 2 for ions of the invention.

This magnetic trap 2 for ions comprises a gastight processing enclosure 4 of generally cylindrical shape about a longitudinal axis XX', and connected to a pump device 6.

By way of example, the pump device 6 comprises an assembly of turbomolecular pumps, diaphragm pumps, and pipework for injecting and extracting gas in order to control the density and the nature of the atmosphere inside the enclosure 4.

In operation, the pump 6 serves to create an ultrahigh vacuum inside the enclosure 4 at a pressure of about $10^{-8}$ millibars.

Inside the enclosure 4, the mass spectrometer includes a filament 7 for generating electrons, serving in particular to emit electrons in order to create ions inside the enclosure 4.

A confinement cell 8 defining a processing volume in which the movement of ions can be analyzed is provided within the enclosure 4.

The cell 8 comprises two trapping electrodes 10 of plane and square shape extending parallel to each other and parallel to the longitudinal axis XX' of the enclosure 4.

Each electrode 10 presents an opening 11 in its middle, and the electrodes 10 are disposed in such a manner that their openings are in alignment with the electron emission axis of the filament 7.

The electrodes 10 are also electrically connected to a direct current (DC) trapping voltage generator 12, in order to be electrically charged to a predetermined potential.

The cell 8 also includes two exciter electrodes 14 that are plane and square in shape, extending parallel to each other, perpendicularly to the trapping electrodes 10, and perpendicularly to the longitudinal axis XX' of the enclosure 4.

The exciter electrodes 14 are electrically connected to an excitation signal generator 16.

Finally, the cell 8 includes two detector electrodes that are plane and square in shape, extending parallel to each other and perpendicularly to the trapping electrodes 10 and also to the exciter electrodes 14.

The measurement electrodes 18 are connected to a measurement device 20, e.g. constituted by a microcomputer provided with appropriate electronic cards for acquisition purposes and with appropriate analysis software.

The trapping electrodes 10, the exciter electrodes 14, and the measurement electrodes 18 are disposed in such a manner that the cell 8 is generally in the form of a cube, or more generally in the form of a rectangular paralellepiped.

For example, the electrodes used are square plates having a side of 20 mm, made on the basis of an ARCAP AP4 material mounted on an insulating support of Macor and electrically connected using silver wires.

The ion trap 2 also comprises two identical permanent magnets 30 of cylindrical shape and hollowed out so as to present cavities on their longitudinal axes. Each magnet is thus in the form of a hollow cylinder or a tube.

Figure 3:
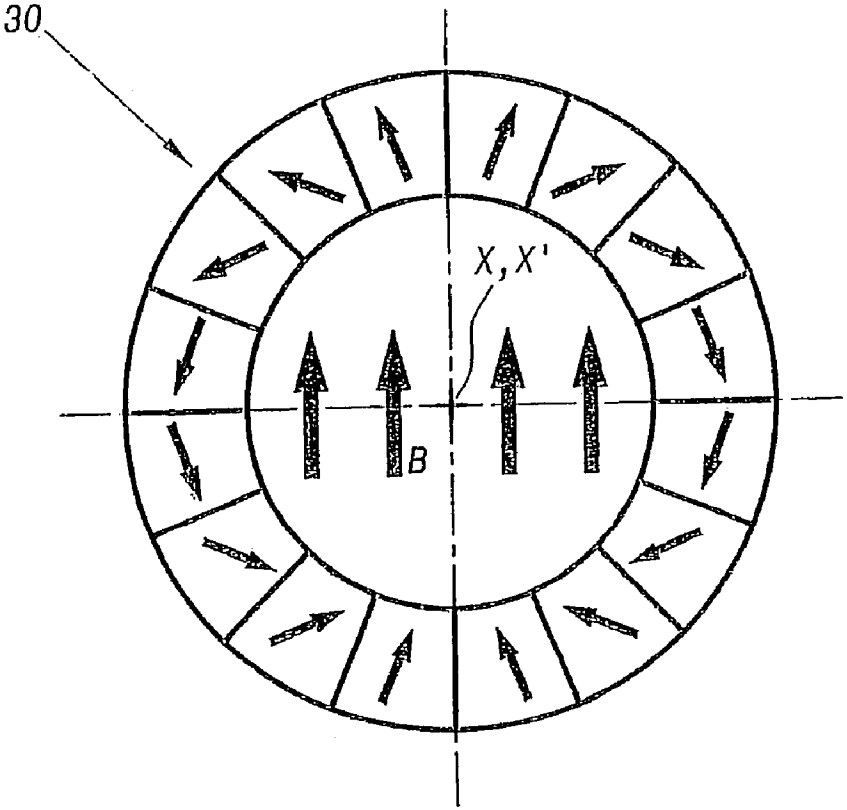
FIGS. 2 and 3 are cross-sections of the permanent magnets used in the invention.
Figure 2:
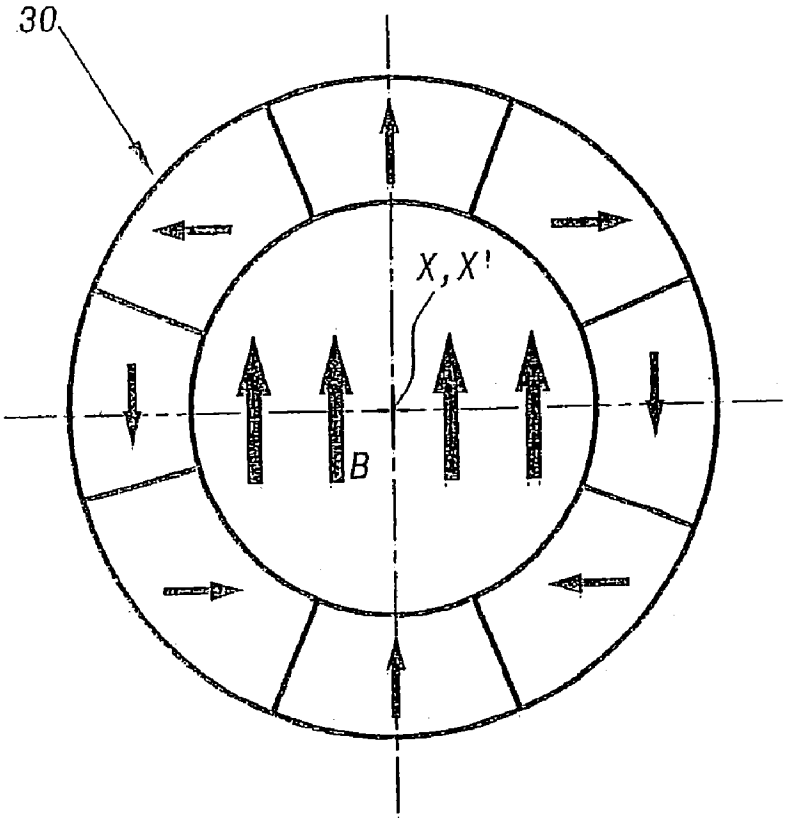

The magnets 30, described in greater detail below with reference to FIGS. 2 and 3, are structured permanent magnets having a structure of the type known as a Halbach cylinder. Such magnets are described in particular in document WO-A-00/62313.

Because of its structure, each magnet 30 generates a uniform magnetic field B that is oriented transversely across its longitudinal axis.

The magnets 30 present annular sections as shown in the section views of FIGS. 2 and 3.

Each magnet comprises a plurality of individual segments magnetized in different directions and distributed angularly around the axis, each generally extending along a longitudinal generator line of the magnet 30.

A Halbach cylinder has a structure that is symmetrical about a plane of symmetry defined by the longitudinal axis of the cylinder and the direction of the uniform magnetic field B created by the cylinder.

The individual segments making up the cylinder thus correspond in pairs symmetrically on either side of the plane of symmetry, and they are magnetized in directions that are symmetrical relative to said plane.

In addition, the individual segments disposed on the same side of the plane of symmetry are magnetized in directions that vary progressively over a range of 360° as a function of the angular position of the segment around the half-cylinder defined beside the plane of symmetry.

In other words, the segments are disposed in a ring in a sequence such that the segments that are symmetrical about the longitudinal axis of the cylinder are magnetized with the same orientation. In addition, the change in angle between the directions of magnetization between two adjacent segments is constant.

This variation in magnetization direction differs from one segment to another by an angle corresponding to 360° divided by half the number of segments.

Thus, as described with reference to FIG. 2, the magnet 30 has eight segments, such that the magnetization direction of each segment is offset by 90° relative to the magnetization directions of the segments adjacent thereto.

Similarly, with reference to FIG. 3, the sixteen segments present magnetization directions that are offset relative to one another by 45°.

Each magnet 30 in the form of a hollow cylinder generates, inside its cavity and perpendicularly to its longitudinal axis, a magnetic field B that is uniform, permanent, and of high intensity.

For an infinite length, the theoretical magnetic field B obtained in this way in each cylinder satisfies the following formula:

$$B = B_r \ln \frac{r_0}{r_1}$$

In this formula, $B_r$ is the remanent magnetic field due to the materials used, $r_0$ is the outside diameter of the cylinders 30, and $r_1$ is the inside diameter.

The length of the cylinder has an effect on the real intensity of the magnetic field and also on its uniformity.

By way of example, the magnets 30 are made of neodymium, iron, and boron (Nd—Fe—B), presenting an outside diameter of 20 centimeters (cm), and inside diameter of 5 cm, and a length of 10 cm. Each of them thus generates a permanent magnetic field of 1 T with uniformity of about 1 part in 100 within a central volume of about 1 cubic centimeter ($cm^3$).

In the embodiment described with reference to FIG. 1, the two magnets 30 are placed on the same axis and they are spaced apart axially by a gap δ. In addition, they are disposed in such a manner that the structure of their magnetic poles are directed identically so as to generate uniform magnetic fields oriented in the same direction.

With the dimensions chosen for the magnets 30, the gap δ is typically less than 1 mm, advantageously lying in the range 0.3 mm to 0.7 mm, and is preferably equal to 0.5 mm.

When aligned in this way, the magnets 30 form in their center a cavity 32, and given their structure and their disposition, they generate throughout the cavity 32 a magnetic field that is uniform and of high intensity.

The magnetic field created by the magnets 30 in the cell 8 is not less than the magnetic field of each magnet 30, such that the cell 8 is subjected to a magnetic field of at least 1 T.

It can also be seen that using two 1 T magnets 30, the two-part structure taken by way of example makes it possible to obtain a magnetic field in the confinement cell 8 having an intensity of 1.25 T, which is a value equivalent to that which would be provided by a single magnet of the same material, length, and section.

In addition, by adjusting the gap δ, it can be seen that said two-part structure described with reference to FIG. 1 makes it possible to obtain increased uniformity of the magnetic field along the longitudinal axis in a zone of much greater length than that which is obtained in the center of an equivalent single magnet.

For this purpose, the gap δ is adjusted to obtain a magnetic field of maximum uniformity in the cell 8. Similarly, the dimensions of the magnets 30 are adjusted to within ±10%.

In operation, the processing enclosure 4 is disposed on the axis inside the cavity 32 defined by the magnets 30, such that the axis XX' represents the longitudinal axis of the enclosure 4 and of the magnets 30.

The enclosure 4 is oriented in such a manner that the trapping electrodes 10 are perpendicular to the magnetic field B generated by the magnets 30.

Thereafter, samples of gas are injected into the enclosure 4 by the pumping device 6.

The filament 7 then emits electrons which penetrate into the cell 8 through the openings 11 in the trapping electrodes 10. These electrons ionize the molecules of gas contained inside the enclosure 4, and in particular inside the cell 8.

The ions produced thereby are then trapped inside the confinement cell 8 and they can be excited in such a manner as to obtain a mass spectrum by so-called "fast Fourier transform (FTT)" analysis.

It can thus be seen that the ion trap 2 presents a cell 8 having a volume of about 8 $cm^3$ and a magnetic field of 1.25 T.

The magnetic trap 2 for ions is thus small in size while still enabling a uniform magnetic field of high intensity to be created in a cell that is of a size that is large enough to enable experiments to be performed.

In addition, the pump device 6, the generators 12 and 16, and the analysis means 20 are all small in size, such that the mass spectrometer described with reference to FIG. 1 constitutes an installation of overall size of about one cubic meter and of weight of about one hundred kilograms.

Similarly, the mass spectrometer requires a standard power supply only and may optionally run on a battery so as to make it easily transportable.

With reference to FIGS. 4 to 7, there follows a description of operating details of the mass spectrometer described above.

The device 6 establishes an ultrahigh vacuum in the enclosure 4 into which samples for analysis are injected in gaseous form. By way of example, these injections are performed by a pulsed valve operating with open periods of about ten milliseconds.

Under the effect of excitation, the filament 7 generates electrons that are emitted towards the processing enclosure 4 in order to ionize the molecules contained therein.

These electrons 40 pass through one of the trapping electrodes 10 via the openings 11 and they penetrate into the cell 8. They then ionize the molecules contained within the cell 8 by colliding with them, thereby causing ions 40 to appear.

Figure 4:
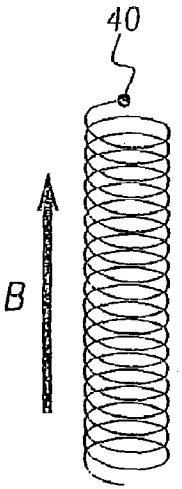
FIG. 4 is a diagram showing the principle of ion motion in a uniform magnetic field.

As shown with reference to FIG. 4, these ions 40 are subjected to the magnetic field B and describe trajectories that are generally helical in shape.

In operation, the trapping electrodes 10 are charged to a constant potential V by the DC generator 12.

Figure 5:
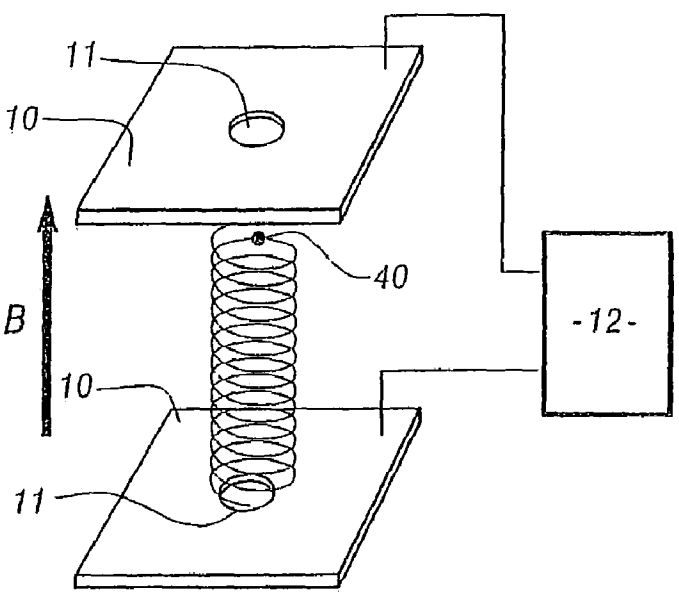
FIG. 5 is a fragmentary perspective diagram of trapping electrodes contained in an ion trap of the invention.

Because of the combination of the magnetic field B and the repulsion generated by the trapping electrodes 10 charged to potentials V, and as shown with reference to FIG. 5, the ions 40 are maintained inside the cell 8 between the trapping electrodes 10. The other electrodes that are not shown in FIG. 5 also contribute to this trapping by generating a potential well between the electrodes 10.

Figure 6:
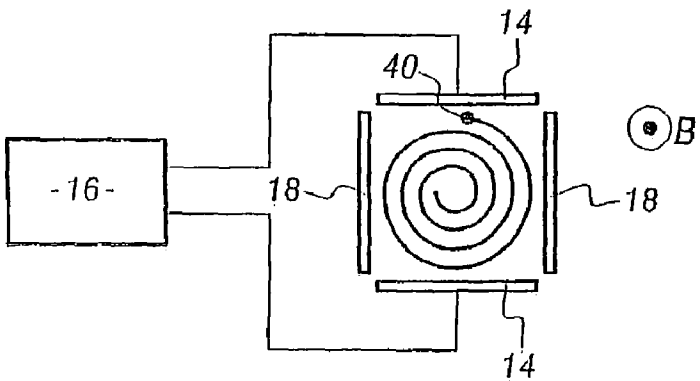

Thereafter, and as shown with reference to FIG. 6, the generator 16 delivers excitation signals to the exciter electrodes 14, which signals are at a mutual phase offset of 180°.

Depending on the frequency of the excitation signals applied to the electrodes 14, the circular movement of the electrodes 40 maintained within the cell 8 is modified, and in particular the radii of their trajectories vary.

Thus, as a function of the frequency of the excitation signals delivered by the generator 16 to the electrodes 14, the ions enter into resonance, and they can be ejected from the cell 8 by enlarging their trajectories, or they can be excited coherently so as to describe stable trajectories of large radius.

Ions are thus obtained inside the cell 8 that are driven with cyclotron movement of large amplitude.

Figure 7:
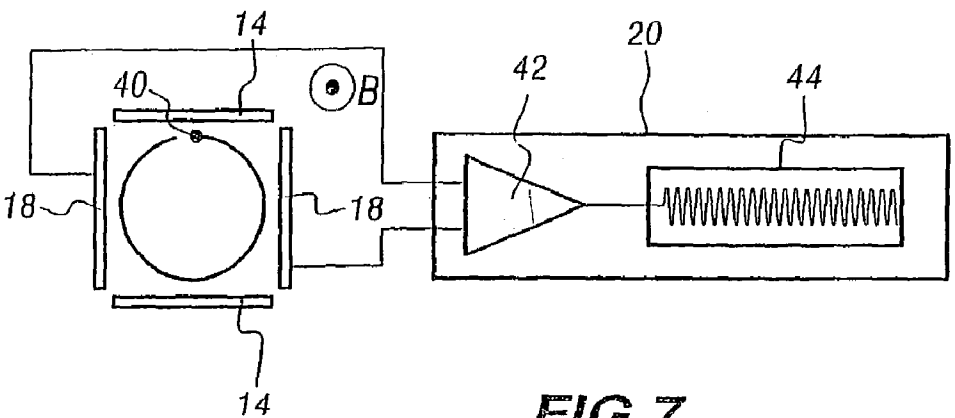
FIGS. 6 and 7 are views from above of the confinement cell of the ion trap of the invention.

As shown with reference to FIG. 7, it is then possible to perform various measurements on these ions.

When the ions 40 are in-phase, their coherent movement induces an electrical signal in the detector electrodes 18.

This electrical signal is applied to the measurement means 20 which amplify it by means of an amplifier 42 prior to processing it in processor means 44. By way of example, the processor means enable the induced signal to be sampled prior to being digitized, and then serves to perform a fast Fourier transform so as to obtain a frequency spectrum for the cyclotron resonance.

Using conventional calibration relationships, this frequency spectrum makes it possible to determine accurately the mass of the ions 40 contained in the cell 8.

Figure 8:
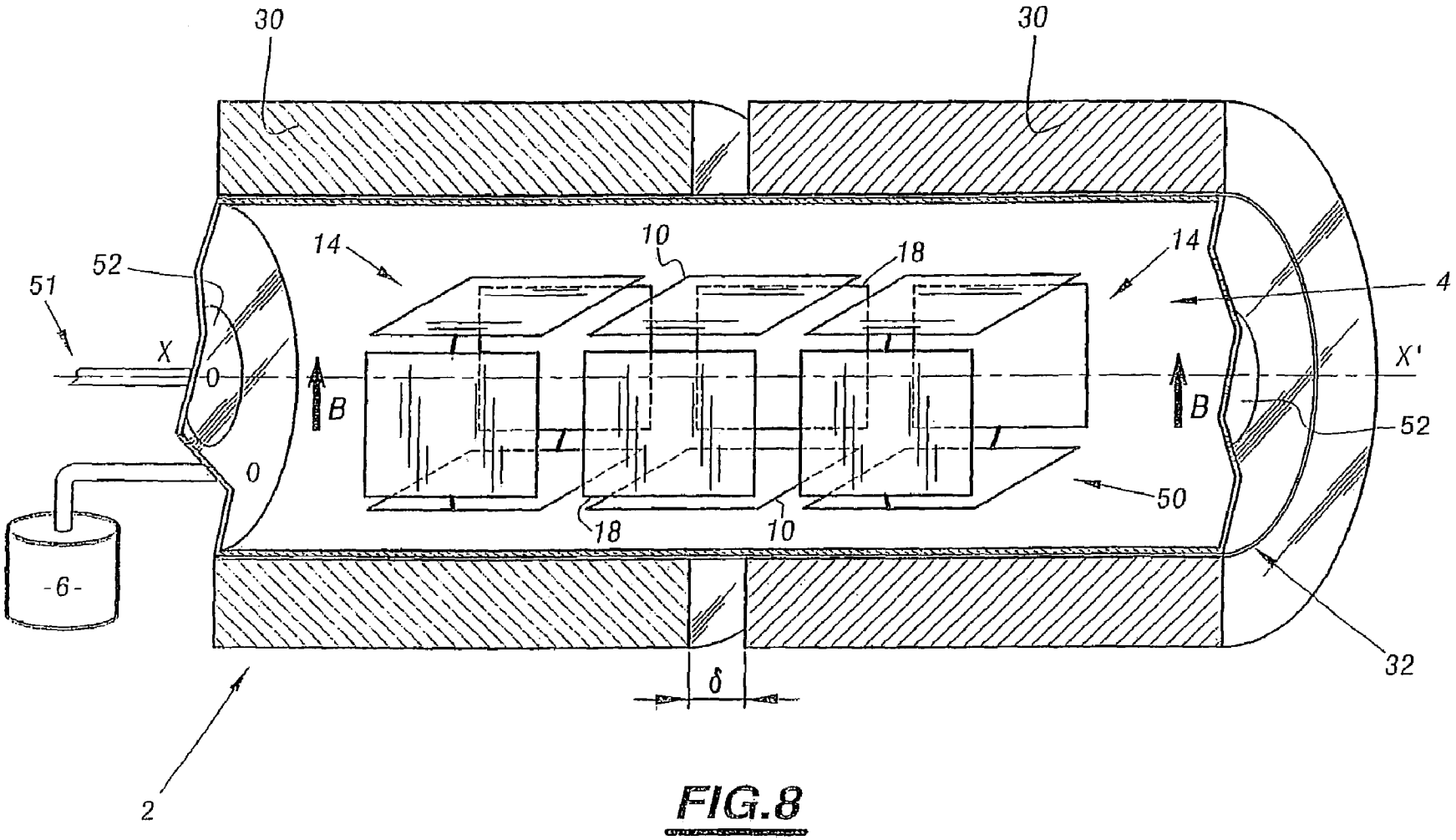
FIG. 8 is a fragmentary section view of a second embodiment of the ion trap of the invention.

With reference to FIG. 8, there follows a description of a second embodiment of the invention.

This figure is a fragmentary section view of a magnetic trap 2 for ions having an axis XX'.

As above, the ion trap 2 includes the enclosure 4 integrated inside the cavity 32 of the structured cylindrical magnets 30.

As described above with reference to FIG. 1, the confinement cell 8 placed inside the processing enclosure 4 comprises two plane and square trapping electrodes 10 that are parallel to each other and that extend perpendicularly to the magnetic field B.

The two detector electrodes 18 are disposed perpendicularly to the electrodes 10 and parallel to the longitudinal axis of the magnets 30.

In this embodiment, each of the excitation electrodes 14 is constituted by four square plates that are electrically interconnected, and that together define a structure in the form of a cube that is open via two opposite faces.

The openings in the two cubes constituting the electrodes 14 face towards each other along the longitudinal axis of the magnets 30.

The set of electrodes thus defines, inside the enclosure 4, a confinement cell 50 that is generally in the form of a tunnel extending along the longitudinal axis XX' of the magnets 30.

Such a structure can be defined as being an open structure and presents numerous implementation advantages, in particular for ionizing the molecules present inside the enclosure 4 and for characterizing the ions by means of interaction with beams of photons or with other molecules.

For this purpose, the enclosure 4 includes means for connection to gas injection means 51 and includes port-holes 52 at its ends so as to make it possible to project gases directly into the cell 50, or to cause photons to pass through the cell via the port-holes 52, said photons being emitted by a laser beam, for example.

It can thus be seen that the magnetic trap 2 for ions of the invention is small in size and compact while enabling high quality processing to be performed on a large quantity of samples.

In other embodiments of the invention, the structured cylindrical magnets constituted by Halbach cylinders are integrated inside the processing enclosure.

Similarly, it is possible to make an ion trap of the invention from a single magnet or with electrodes of other shapes, such as, for example, electrodes that are cylindrical or rectangular.

Furthermore, the excitation voltage generator, the trapping voltage generator, and the measurement means may be constituted by a single device, such as a microcomputer fitted with electronic input/output cards that are suitable for generating excitation signals and trapping voltages.

Finally, it is also possible to perform processing on ions that are positive or negative, by inverting the polarities of the trapping electrodes.

What is claimed is:

1. A vacuum ion trap, the trap comprising a gastight processing enclosure (4) and a permanent magnet (30) defining a cavity (32) and creating a uniform and directed magnetic field (B) in said cavity (32), said enclosure (4) being disposed inside said cavity (32) and containing a confinement cell (8; 50) comprising at least two mutually parallel trapping electrodes (10) perpendicular to said directed magnetic field (B), said trapping electrodes (10) being connectable to a voltage generator (12), the trap including at least one permanent magnet (30) in the form of a hollow cylinder and structured with a Halbach cylinder type structure so as to generate said permanent magnetic field (B) that is uniform and directed perpendicularly to the longitudinal axis (XX') of the cavity (32) of said magnet (30).

2. An ion trap according to claim 1, wherein the dimensions and the composition of the or each magnet (30) are adapted to generate a uniform permanent magnetic field (B) of intensity of at least 0.8 T.

3. An ion trap according to claim 1, wherein it includes two permanent magnets (30) in the form of hollow cylinders, both structured with a Halbach cylinder type structure, and of identical dimensions and composition, the magnets being disposed in axial alignment on the same longitudinal axis (XX') and being oriented in such a manner as to cause the magnetic fields (B) they generate to be directed identically.

4. An ion trap according to claim 3, wherein the two permanent magnets (30) are spaced apart from each other along their longitudinal axis (XX') by a predetermined non-zero gap (δ) in order to increase the uniformity of said magnetic field (B).

5. An ion trap according to claim 4, wherein said gap (δ) is less than 1 mm.

6. An ion trap according to claim 1, wherein the or each permanent magnet (30) presents an inside diameter in the range 45 mm to 55 mm, an outside diameter in the range 180 mm to 220 mm, and a length in the range 90 mm to 110 mm.

7. An ion trap according to claim 1, wherein the or each permanent magnet (30) is made up of individual segments of Nd—Fe—B.

8. An ion trap according to claim 1, wherein said confinement cell (8; 50) further comprises two mutually parallel detector electrodes (18) perpendicular to said trapping electrodes (10), said detector electrodes (18) being connectable to measurement means (20) in order to transmit information relating to the movements of ions (40) contained in said confinement cell (8; 50).

9. An ion trap according to claim 8, wherein said confinement cell (8; 50) further comprises two mutually parallel exciter electrodes (14) perpendicular to said trapping electrodes (10), said exciter electrodes (14) being connectable to an excitation signal generator (16) in order to excite ions (40) contained in said confinement cell (8; 50).

10. An ion trap according to claim 9, wherein said trapping, exciter, and detector electrodes (10, 14, 18) are plane and rectangular in shape so that said confinement cell (8) is generally in the form of a rectangular parallelepiped.

11. An ion trap according to claim 10, wherein each of said exciter electrodes (14) is constituted by four plates arranged generally in the form of a rectangular parallelepiped that is open via two opposite faces, said exciter electrodes (14) being disposed on a common axis on either side of said trapping electrodes (10), said open faces facing each other so that said confinement cell (50) is generally in the form of a tunnel.

12. An ion trap according to claim 11, wherein said confinement cell (50) that is generally in the form of a tunnel is placed on the longitudinal axis (XX') of said magnet (30).

13. An ion trap according to claim 12, wherein said processing enclosure (4) includes, at at least one end, a port-hole (52) disposed on the axis (XX') of the cell (50) that is generally in the form of a tunnel, and that allows photons to pass therethrough.

14. An ion trap according to claim 1, wherein the processing enclosure (4) includes means for connection to pump means (6) and to means (51) for injecting gas in order to control the density and/or the nature of the atmosphere inside the processing enclosure (4).

15. An ion trap according to claim 1, wherein it is associated with means (7) for emitting electrons towards said enclosure (4) in order to generate ions (40) at least in said confinement cell (40).

16. A mass spectrometer comprising a magnetic trap (2) for ions, a pump device (6), a trapping voltage generator (12), and measurement means (20) suitable for performing Fourier transform analysis of the cyclotron movement of ions (40) contained in the ion trap (2), wherein said magnetic trap (2) for ions is a trap according to claim 1.

* * * * *